United States Patent [19]

Alexander et al.

[11] 4,023,710

[45] May 17, 1977

[54] PRESSURE PACK VALVE FOR DISPENSING PARTICULATE MATERIALS

[75] Inventors: David John Alexander, Twickenham; Rustom Kooverji Gamadia, London, both of England

[73] Assignee: Lever Brothers Company, New York, N.Y.

[22] Filed: Sept. 17, 1974

[21] Appl. No.: 506,929

Related U.S. Application Data

[63] Continuation of Ser. No. 366,885, June 4, 1973, abandoned, which is a continuation-in-part of Ser. No. 292,041, Sept. 25, 1972, abandoned.

[30] Foreign Application Priority Data

Sept. 29, 1971 United Kingdom ..... 45282/71
June 8, 1972 United Kingdom ..... 26700/72

[52] U.S. Cl. ..... 222/148; 222/402.24; 251/353; 251/355

[51] Int. Cl.[2] ..... B65D 83/14; F16K 31/58

[58] Field of Search ..... 222/148, 192, 394, 402.18, 222/402.24, 518, 402.2, 402.1; 251/341, 347, 348, 353, 354, 355

[56] References Cited

UNITED STATES PATENTS

| | | | |
|---|---|---|---|
| 3,406,846 | 10/1968 | Klun | 222/402.24 X |
| 3,586,216 | 6/1971 | Jordan | 222/402.12 |
| 3,722,759 | 3/1973 | Rodden | 222/402.24 X |
| 3,733,009 | 5/1973 | Rouzier et al. | 222/148 |

FOREIGN PATENTS OR APPLICATIONS

| | | | |
|---|---|---|---|
| 1,594,015 | 7/1970 | France | 222/402.24 |

*Primary Examiner*—Robert B. Reeves
*Assistant Examiner*—Frederick R. Handren
*Attorney, Agent, or Firm*—Arnold Grant

[57] ABSTRACT

A valve for a pressure pack primarily designed for dispensing powders in the absence of liquid. The valve has the usual housing, gasket, stem, spring and mounting flange components but the special problems of dispensing powders are overcome (a) by introducing a liquid film between the sealing surfaces; (b) by physically removing particulate material from the valve stem by wiping and (c) by providing a double seal between the pressurized contents of the can and the atmosphere. In a further modification, the valve stem is connected to or continuous with the dip tube.

6 Claims, 3 Drawing Figures

PRESSURE PACK VALVE FOR DISPENSING PARTICULATE MATERIALS

REFERENCE TO EARLIER APPLICATION

This application is a continuation of application Ser. No. 366,885, filed June 4, 1973 (abandoned) which is in turn, a continuation-in-part of U.S. application Ser. No. 292,041, filed Sept. 25, 1972, now abandoned.

BACKGROUND OF THE INVENTION

This invention relates to a valve for a pressurized pack, commonly known as an aerosol can, and particularly to such a valve for dispensing powders from a pressurized pack.

A conventional valve for an aerosol can is illustrated in FIG. 6-1 of "Principles of Aerosol Technology" by Paul A. Sanders, published by Van Nostrand Rheinhold Company, New York. This valve consists of a housing, an elastomeric gasket, a valve stem and a valve spring, the gasket and housing being held together by a mounting flange which also serves to mount the valve in the can. When the valve is closed outlet orifices on the valve stem are sealed by the gasket but when the valve is open these orifices are in communication with the pressurized contents of the can.

The problem involved in producing a satisfactory valve of this type for dispensing powders from a pressurized pack is a considerable one. Particles of the powder become trapped between the sealing surfaces of the valve, reducing the effectiveness of the seal obtained and leading eventually to leakage and loss of pressure in the pack.

A number of attempts at solving this problem have been made and some of the resultant valves have been used commercially. However, none has been entirely satisfactory. In some cases it has been necessary to adopt a discontinuous flew system to avoid leakage problems. This approach is inherently unsatisfactory from the consumers' point of view.

SUMMARY OF THE INVENTION

In the valve described below these problems have been approached first by introducing a liquid film between the sealing surfaces of the valve, secondly by physically removing particulate material from the valve stem by wiping the thirdly by providing a double seal between the pressurized contents of the pack and the atmosphere.

The present invention relates to a valve for a pressurised pack of the type comprising a valve housing defining an intermediate chamber, the housing having a resiliently loaded valve stem formed with an outlet orifice and a hollow discharge outlet and a primary elastomeric gasket for separating the pressurized contents of the pack from the atmosphere, the stem travelling in the housing between a closed position at which the primary gasket acts to seal the outlet orifice and an open position at which the outlet orifice communicates the intermediate chamber and the discharge outlet.

Accordingly, in a first aspect, the invention provides a valve of the above type wherein the housing also contains a supply of liquid arranged to contact the outside of the valve stem during its travel so that a liquid film is present between the stem and the gasket when the valve stem is in the closed position.

In a second aspect of the invention the housing also contains a wiping material arranged to remove particulate material derived from the pressurized contents of the pack from the outside of the valve stem during its travel from the open to the closed position.

In a third aspect of the invention the housing also contains a secondary elastomeric gasket in sealing engagement with the valve stem at a position inwards of the primary gasket to provide a double seal between the pressurized contents of the pack and the atmosphere.

Finally, in a fourth aspect of the invention, any of these three aspects is combined with attaching the dip tube for the valve directly to the valve stem.

According to one embodiment of the invention, the wiping material comprises an annulus of resilient material which is slightly undersize on the valve stem through which the latter passes during its travel from the open to the closed position. The resilient material, which may be a foam of open cell structure such as "Neoprene" (Trade Mark) may be impregnated with a liquid, for example a silicone lubricant such as "Silicone Fluid 76." In this way a film of liquid can be transferred to the valve stem and hence formed between the stem and the primary gasket when the valve stem is in the closed position. Simultaneously, particulate material can be removed from the outside of the valve stem during its travel.

In a valve having a secondary elastomeric gasket it is advantageous for the valve housing to contain a rigid cup disposed between the primary and secondary gaskets, the base of the cup maintaining the secondary gasket against a shoulder on the housing whereby distortion of the gasket during movement of the valve stem is substantially prevented. In this arrangement, if it is desired to provide wiping material in the form of an annulus of resilient material, it is convenient for this to be contained in the cup.

Whether or not the valve is provided with a secondary elastomeric gasket, improved sealing will normally be obtained if the housing contains an inverted rigid cup disposed inwards of the primary elastomeric gasket, the primary gasket being sandwiched between the top of the cup and a mounting flange for mounting the valve in the pressurized pack whereby distortion of the primary gasket is substantially prevented.

In spite of the considerable improvement in the dispensing of powdered products made possible by the foregoing, we have noted that valve blockage can still sometimes occur due to deposition of powder within the chamber which can occlude the outlet orifice, usually near the inward end of the valve stem, which communicates the pack contents with the discharge outlet when product is dispensed. We have now discovered that this particular problem can be overcome by attaching the dip tube for the valve directly to the valve stem rather than to the housing as is conventional so that the valve stem then extends through the intermediate chamber within the housing.

The intermediate chamber is therefore arranged to receive a single piece, partly hollow, valve stem which at its inner end is attached to a continuous with the usual dip tube, and at its discharge end is in communication with the actual actuator means, such as a valve button.

The valve stem is formed with an inlet orifice communicating the hollow dip tube end with the intermediate chamber, and with an outlet orifice adapted to communicate the hollow discharge end with the intermediate chamber when the valve stem is in the discharge position. In the closed position, the outlet orifice is normally sealed by the primary sealing gasket, the valve stem being urged to this position by a coil spring in compression. The mid region of the valve stem is solid to prevent uncontrolled discharge of material in the pressure pack to atmosphere.

When the valve stem is depressed to the discharge position, the powdered product in the pack passes through the dip tube and the dip tube end of the valve stem, via the inlet orifice to the intermediate chamber from where it flows via the outlet orifice to the discharge end of the valve stem and thence to atmosphere.

When powder particles are being carried alone in a steam of gas, the number of particles which the gas can carry is determined by its velocity. The greater the velocity of the gas the more particles it can carry. If the velocity of the gas stream is reduced, particles will be deposited from the stream in the area of the reduction in velocity. In order therefore to reduce powder drop-out to a minimum, it is preferable that the cross-sectional area of the pathway through which the stream of powder particles passes is substantially uniform, or that where a reduction or enlargement of this area is inevitable, an appropriate compensating increase or decrease in area is incorporated elsewhere in the pathway.

The inlet and outlet orifices are, usually, of smaller cross-sectional area than that of the hollow portions of the valve stem and intermediate chamber. When, therefore, the pressure pack is operated, the velocity of the discharging stream of gas and powder particles would be expected to be increased through these orifices causing drop out of particulate material elsewhere in the system where the cross-sectional area is larger and the velocity correspondingly lower. This effect can, however be almost entirely eliminated, according to a preferred embodiment of this aspect of the invention, by providing two or more inlet orifices opening from the hollow dip tube end of the valve stem to the intermediate chamber, and a single outlet orifice communicating the intermediate chamber with the hollow discharge end of the valve stem, the total cross-sectional areas of these inlet orifices being proportionally greater than that of the single outlet orifice.

The intermediate chamber can also be constructed so as to provide a cross-sectional area which compensates for any change in flow rate resulting from constricting of the flow path through these orifices.

By way of example to illustrate the inter-relationship of the flow path dimensions of a pressure pack valve according to the invention, a tubular valve stem was constructed with an internal diameter at the dip tube end of 0.15 mm and an internal diameter at the outlet end of 0.19 mm, the mid region of the stem being solid. Two radial inlet orifices communicated the dip tube end and the intermediate chamber, and a single radial orifice communicated the discharge end with the intermediate chamber when the valve stem was depressed to the discharge position. The diameter of each of these orifices was 0.05 mm.

It was shown in several trials that a powder product consisting of talc having an average particle size of about 25 m $\mu$ and a density of 1 g/cc could be dispensed without valve blockage from a pack to which this valve was fitted using a propellent gas at a pressure of about 2 kg/cm$^2$.

According to a further embodiment of the invention, the intermediate chamber in the housing may be formed with vertically extending vanes and a set of shoulders on these vanes may act to limit the travel of the valve stem as in a conventional pressure pack valve. Also, it is preferred that a seal is provided to prevent entry of propellent gas from the head space of the pressure pack into the intermediate chamber. This may be achieved by an arrangement wherein the lower end of the valve spring butts against an elastomeric gasket seated in the floor of the chamber whereby entry of the propellent vapor to the chamber is substantially prevented.

In one example of a valve in accordance with this invention, the travel of the valve stem is limited to the difference between the extended and compressed lengths of the valve spring.

The invention will be further described with reference to the accompanying drawings in which.

Figure 1:
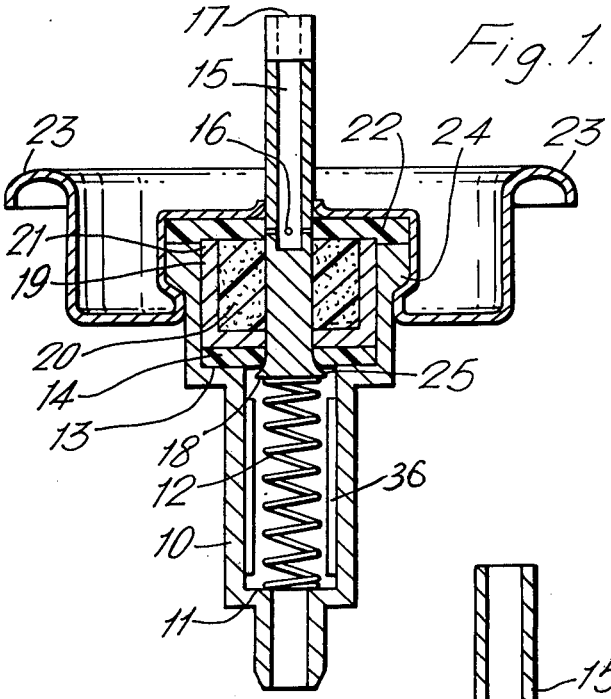
FIG. 1 is a section through a valve for a pressurized pack in accordance with the invention.

Referring first to FIG. 1, the valve consists of six components within an envelope formed by housing 10 and a mounting flange 23. The housing 10, open at both ends, is injection moulded from an acetal resin with a first shoulder 11 for abutment with a spring 12 and a second shoulder 13 for abutment with a secondary elastomeric gasket 14 made of Neoprene (Trade Mark). The housing contains a hollow valve stem 15 formed with outlet orifices 16 inward of the discharge outlet 17. In the assembled valve, the valve stem 15 is urged outwardly of the housing by the spring 12 in compression between the shoulder 11 on the housing and a foot 18 on the valve stem.

The secondary gasket 14, which is slightly undersize on the valve stem is sandwiched between the second shoulder 13 on the housing 10 and a rigid valve cup 19 containing wiping material in the form of an annulus 20 of open cell Neoprene foam impregnated with a silicone fluid lubricant. The upstanding wall 21 of the cup 19 extends slightly beyond the top of the housing 10 so that when a primary elastomeric gasket 22 is placed on top of the cup containing the foam annulus 20 and a mounting flange 23 is crimped onto the lip 24 of the housing 10, the cup is urged downwardly and compresses the secondary gasket 14 against the shoulder 13 of the housing to effect a seal. An abutment 25 on the foot of the valve stem is sealed against the secondary gasket 14 by the pressure of the valve spring 12 when the valve is in the closed position.

In use the valve is crimped into the top of a suitable can by means of the mounting flange 23. The valve is opened in the normal way by depressing an actuator button (not shown) to a position where the outlet orifices 16 in the valve stem are below the lower surface of the secondary gasket and thus in communication with the contents of the pack. These are pressurized and flow up a dip tube (not shown), through the valve-housing and stem and out into the atmosphere. The valve is closed by releasing the actuator button whereupon the spring 12 drives the foot of the valve stem upwards until the abutment 25 is in sealing engagement with the secondary gasket 14 and the outlet orifices 16 are sealed by the primary gasket 22.

The advantage of the arrangement described above is that the external portion of the valve stem which comes into contact with the contents of the aerosol can, and especially the portion adjacent the outlet orifices 16, is wiped free from powder particles by the foam annulus 20 during its return stroke. Liquid lubricant is also applied to the external surface of the valve stem during the return stroke. By a combination of these two factors a good seal is obtained at the primary gasket. Thus even if some leakage occurs at the seal effected by the secondary gasket, the primary gasket provides another line of defence and the pack remains pressurized.

Figure 2:
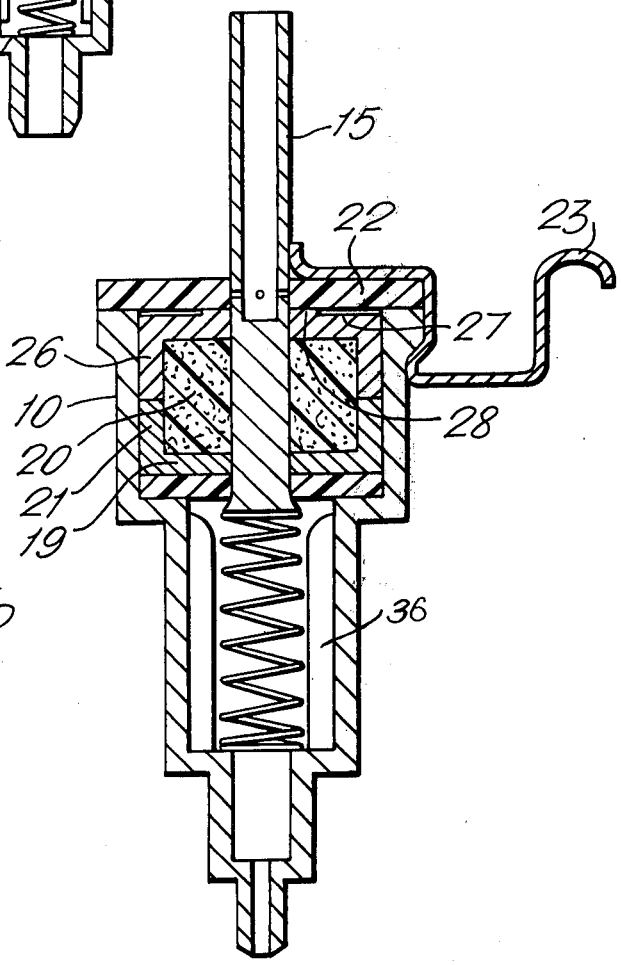
FIG. 2 is a section through a modification of the valve shown in FIG. 1.

In a modification of the above valve shown in FIG. 2 the upstanding wall 21 of the cup 19 is substantially shorter than the adjacent wall of the housing 10 so that there is room for a second, inverted cup 26 to be fitted beneath the primary gasket 22. As in the valve shown in FIG. 1, the valve stem 15 passes through a lubricant impregnated foam annulus 20. However, in the modified valve the annulus is completely surrounded by the rigid valve cups 19 and 26. The top 27 of inverted cup 26 bears a raised portion 28 adjacent the valve stem 15 and the primary gasket 22 is firmly sandwiched between this portion and the mounting cup 23 only part of which is shown in this figure.

The advantage of this arrangement over that shown in FIG. 1 is that the primary gasket is firmly clamped in one plane as described above and so the likelihood of puckering of the gasket and consequent leakage of the material from the valve is reduced.

Figure 3:
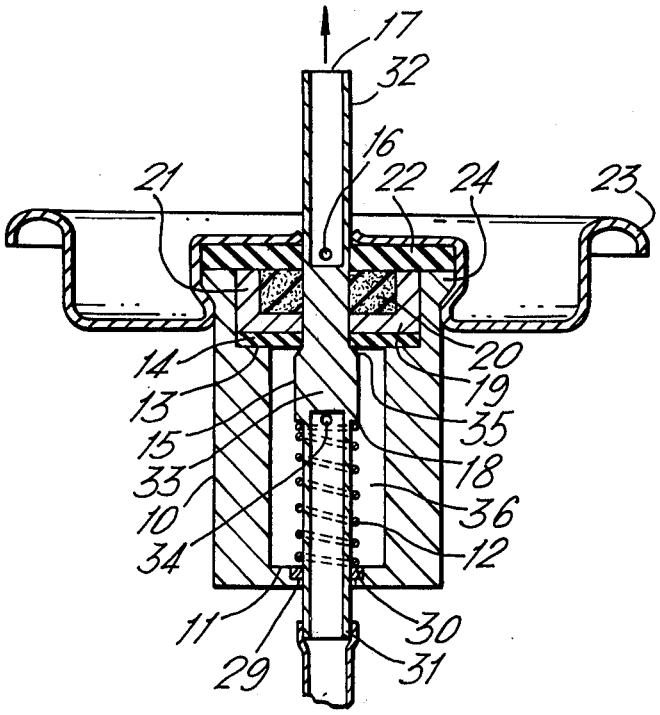
FIG. 3 is a section through a further modification of the valve shown in FIG. 1.

In further modification shown in FIG. 3, the valve consists of seven components within an envelope formed by a housing 10 and a mounting flange 23. The housing 10, open at both ends, is injection moulded from an acetal resin. The base of the housing is formed with an opening to take the dip tube end 31 of the valve stem 15, and with a seat 29 holding an elastomeric annulus 30 which is slightly undersized on the valve stem. A valve spring 12 butts against the annulus 30 and against a shoulder 18 on the stem. The valve stem extends through an intermediate chamber 36 within the housing 10.

Sandwiched between the top surface of the housing 10 and the mounting flange 23 is a primary elastomeric gasket 22 through which the discharge outlet end 32 of the valve stem passes.

A secondary elastomeric gasket 14, is sandwiched between a shoulder 13 on the housing 10 and a rigid valve cup 19 containing wiping material in the form of an annulus 20 of open cell Neoprene (Trade Mark) foam impregnated with silicone fluid lubricant. The upstanding wall 21 of the cup 19 extends slightly beyond the top of the housing 10 so that when the primary gasket 22 is placed on top of the cup containing the foam annulus 20 and the mounting flange 23 is crimped onto the lip 24 of the housing 10, the cup is urged downwardly and compresses the secondary gasket 14 against the shoulder 13 of the housing to effect a seal.

Both the primary and the secondary gaskets are also slightly undersized on the valve stem.

The construction of the valve stem is an important feature of this aspect of invention. The dip tube end 31 of the valve stem 15 is hollow as is the discharge outlet end 32 while the central portion 33 of the stem is solid. Two radially disposed inlet orifices 34, (one of which is shown), are formed in the dip tube end 31, and one radially disposed outlet orifice 16 in the discharge end 32 of the valve stem. When the valve stem is in its normal sealed position, the outlet orifice 16 is sealed by the primary elastomeric sealing gasket 22. In this position a shoulder 35 on the valve stem 15 between the discharge end 32 and the central portion 33 is urged against the underside of the secondary gasket 14 by the spring 12.

Assembly is completed by crimping the valve into the top of a filled can (not shown) by means of the mounting flange 23.

When the valve is opened by depression of the valve stem to its open position, that is by depression of the stem 15 against the resilience of the valve spring 12, the outlet orifice 16 on the discharge outlet is moved below the lower face of the primary gasket 22 and the secondary gasket 14 into the intermediate chamber 36. Material then flows up the dip tube through the dip tube end 31 of the valve stem and into the intermediate chamber 36 via inlet orifices 34. It can then flow through the chamber and out to atmosphere via the outlet orifice 16, the discharge outlet end 32 and the actuator button (not shown).

When the valve is closed, for example by release of the actuator button, resilience of the valve spring 12 drives the valve stem upwards until abutment of the shoulder 25 is in sealing engagement with the secondary gasket 14 and the outlet orifice 16 is sealed by the primary gasket 22.

The axial length of the intermediate chamber 36, in relation to the travel of the valve stem between its open and closed position, is great enough to ensure that even if powdered material from a stream flowing through the valve is deposited in the chamber, this deposit does not cover the inlet orifices when the valve is closed. When the valve is opened again, any material remaining within this chamber is picked up and carried away by the turbulence of the exiting stream flowing from the inlet orifices 34 to the outlet orifice 16.

Our copending U.S. patent application Ser. No. 243,138, filed Apr. 12, 1972, now abandoned, describes and claims a pressurized pack device suitable for dispensing a stream of powdered material at high pressure, comprising a first compartment to contain the material to be dispensed together with a gaseous propellent, a reservoir compartment suitbale to contain liquefied propellant at high pressure and a communicating valve which when opened provides communication between the reservoir compartment and the first compartment and allows propellant gas evaporating from the liquefied propellant to pass from the reservoir compartment into the first compartment to augment the aerosol propellant vapor in the first compartment.

It is preferred that the valve of the present invention be applied to a pressurized pack in accordance with the application referred to.

What is claimed is:

1. A valve for a pressurized pack which comprises:

a. a valve housing defining an intermediate chamber;

b. a mounting flange for mounting the housing in the pressurized pack;

c. an elastomeric gasket separating the interior of the pack from the atmosphere, the gasket being sandwiched between the housing and the mounting flange and being formed with an aperture;

d. a valve stem having a hollow discharge end and an outlet orifice communicating said discharge end with the chamber when the valve is open, the valve stem being movable in the chamber through the aperture formed in the gasket from an open position to a closed position at which the gasket acts to seal the outlet orifice;

e. a valve spring acting against the stem to urge it into the closed position;

f. an annulus of open celled resilient foam material located in the housing and surrounding the valve stem, the annulus being slightly undersize on the valve stem and serving to wipe the valve stem and apply a liquid film to the valve stem during its movement between open and closed positions; and, g. a secondary elastomeric gasket in sealing engagement with the valve stem at a position inwards of the first gasket.

2. A valve according to claim 1 where in the open cell foam is arranged to contain liquid.

3. A valve according to claim 1 wherein a cup is disposed in the housing between the primary and secondary gaskets, and wherein the housing is formed with a shoulder, the base of the cup maintaining the secondary gasket against the shoulder whereby distortion of the gasket during travel of the valve stem is substantially prevented.

4. A valve according to claim 3 wherein the cup contains the annulus of resilient material.

5. A valve according to claim 1 wherein an inverted cup is disposed between the primary and secondary gaskets, the primary gaskets being sandwiched between the top of the cup and the mounting flange, whereby distortion of the gasket during travel of the valve is substantially prevented.

6. A valve for a pressurized pack as defined in claim 5 wherein the open celled foam resilient material is impregnated with a lubricating liquid.

* * * * *